US008717253B2

(12) United States Patent
Aoki et al.

(10) Patent No.: US 8,717,253 B2
(45) Date of Patent: May 6, 2014

(54) ANTENNA

(75) Inventors: Yutaka Aoki, Ome (JP); Kazuhiko Honjo, Tsukuba (JP); Akira Saitou, Machida (JP)

(73) Assignee: Casio Computer Co., Ltd., Tokyo (JP)

( * ) Notice: Subject to any disclaimer, the term of this patent is extended or adjusted under 35 U.S.C. 154(b) by 456 days.

(21) Appl. No.: 13/127,782

(22) PCT Filed: Mar. 4, 2010

(86) PCT No.: PCT/JP2010/053564

§ 371 (c)(1),
(2), (4) Date: May 5, 2011

(87) PCT Pub. No.: WO2011/027582

PCT Pub. Date: Mar. 10, 2011

(65) Prior Publication Data

US 2011/0212697 A1 Sep. 1, 2011

(30) Foreign Application Priority Data

Sep. 2, 2009 (JP) ..... 2009-203147

(51) Int. Cl.
*H01Q 15/02* (2006.01)

(52) U.S. Cl.
USPC ..... 343/909; 343/702

(58) Field of Classification Search
USPC ..... 343/702, 725, 727, 730, 793, 794, 909, 343/705
See application file for complete search history.

(56) References Cited

U.S. PATENT DOCUMENTS

| | | | | |
|---|---|---|---|---|
| 7,248,224 | B2 | 7/2007 | Yuanzhu | |
| 8,059,046 | B2 * | 11/2011 | Nysen | 343/725 |
| 2008/0136710 | A1 | 6/2008 | Nefedov et al. | |

FOREIGN PATENT DOCUMENTS

| | | | |
|---|---|---|---|
| JP | 2005-086518 | A | 3/2005 |
| JP | 2006-180150 | A | 7/2006 |
| JP | 2008-154013 | A | 7/2008 |
| JP | 2010-050628 | A | 3/2010 |

OTHER PUBLICATIONS

International Search Report dated Jun. 8, 2010 issued in International Appln. No. PCT/JP2010/053564.
T. Okagaki et al; A Consideration on MSAs With Electromagnetic-Band-Gap Structure; IEICE Technical Report; Dec. 8, 2 005; vol. 105, No. 467, pp. 65-70.
Japanese Office Action dated Nov. 20, 2012 (and English translation thereof) in counterpart Japanese Application No. 2009-203147.

* cited by examiner

*Primary Examiner* — Karl D Frech
(74) *Attorney, Agent, or Firm* — Holtz, Holtz, Goodman & Chick, PC

(57) ABSTRACT

A miniature variable-beam microwave antenna (1) comprises antenna conductors (100*a*, 100*b*), an EBG conductor (120), a variable reactance element (130), and an adjusting part (150). The EBG conductor (120) is connected to a grounded part (160) through the variable reactance element (130). The adjusting part (150) changes the apparent reactance of the EBG conductor (120) by changing the capacity of the variable reactance element (130). As the apparent reactance of the EBG conductor (120) changes, the directivity of the miniature variable-beam microwave antenna (1) also changes.

11 Claims, 11 Drawing Sheets

DIRECTIVITY AT 5.0 GHz

ANTENNA

This application is a U.S. National Phase Application under 35 USC 371 of International Application PCT/JP2010/053564 filed Mar. 4, 2010.

TECHNICAL FIELD

The present invention relates to an antenna which can adjust a directivity thereof.

BACKGROUND ART

An MIMO (Multiple Input Multiple Output) technology is getting attention as a fast-speed transmission technology. According to MIMO, plural antennas secure respective space propagation channels different from one another, thereby expanding a communication channel capacity. Accordingly, it is requisite for the individual antennas to have a directivity in a different direction.

An example of an antenna device including plural antennas each having a different directivity for MIMO is disclosed in patent literature 1. Like this example, in general, the antenna device for MIMO includes a plurality of antennas each of which is individually configured and which are arranged side by side.

PRIOR ART DOCUMENT

Patent Literature

Patent Literature 1: Unexamined Japanese Patent Application KOKAI Publication No. 2005-086518

DISCLOSURE OF INVENTION

Problem to be Solved by the Invention

When plural antennas are arranged side by side, if the antennas are arranged too close to one another, an interference occurs and negative effects inherent thereto cannot be eliminated, so that a desired characteristic cannot be acquired. Accordingly, in the conventional antenna device for an MIMO system, plural antennas are arranged with a relatively large clearance, and thus the antenna device has a large size. Hence, the whole MIMO system including the antenna device is also large.

It is an object of the present invention to provide an antenna which can control any interference caused as plural antenna conductors are arranged close to one another.

Moreover, it is another object of the present invention to provide a miniature antenna for MIMO.

Furthermore, it is a further object of the present invention to provide a miniature antenna which can control a radiation pattern.

Means for Solving the Problem

To achieve the foregoing objects, an antenna according to the present invention comprises an antenna conductor; an electromagnetic-band-gap conductor which blocks off and reflects a radio wave emitted by the antenna conductor; a variable reactance element which connects the electromagnetic-band-gap conductor and a reference potential part together; and an adjust circuit which adjusts a reactance of the variable reactance element.

For example, the electromagnetic-band-gap conductor may be arranged in a main propagation direction of a radio wave of the antenna conductor.

For example, the antenna conductor has a rectangular tabular shape.

For example, the antenna conductor arranged may be a plurality of antenna conductors, and the electromagnetic-band-gap electromagnetic-band-gap conductor may be arranged between the two adjoining antenna conductors.

For example, the antenna may further comprise a first dielectric plate, and the antenna conductor and the electromagnetic-band-gap conductor may be formed on the first dielectric plate.

For example, the antenna may further comprise a second dielectric plate, and the adjust circuit may be formed on one-side plane of the second dielectric plate.

For example, the antenna may further comprise a high-frequency circuit which superimposes an input analog signal on a high-frequency voltage, applies the high-frequency voltage to the antenna conductor and detects an analog signal from a radio wave received by the antenna conductor, and the high-frequency circuit may be formed on the one-side plane of the second dielectric plate.

For example, the high-frequency circuit is connected to the antenna conductor by slot coupling or by inductive coupling.

For example, the antenna may further comprise a conversion circuit which converts an analog signal input from the high-frequency circuit into a digital signal, outputs the converted digital signal and converts an input digital signal into an analog signal, and the conversion circuit may be formed on the one-side plane of the second dielectric plate.

For example, another-side plane of the first dielectric plate and the one-side plane of the second dielectric plate may be connected together through an insulating layer comprising an insulator, and the antenna may further comprise an external terminal which is connected to the conversion circuit by a wiring conductor passing all the way through the insulating layer and which is arranged on one-side plane of the first dielectric plate.

For example, the first dielectric plate may have a protective layer comprising an insulator arranged on the one-side plane of the first dielectric plate, and the external terminal may pass all the way through the protective layer, may have one end connected to the conversion circuit, and may have another end connected to a terminal for surface mounting.

For example, no conductive material may be arranged in a planar direction of the antenna conductor.

Effect of the Invention

According to the present invention, it is possible to provide a small microwave antenna which can change a directivity using a plurality of antenna conductors arranged close to one another.

BEST MODE FOR CARRYING OUT THE INVENTION

First Embodiment

An explanation will be given of a miniature variable-beam microwave antenna 1 according to a first embodiment of the present invention.

Figure 1:
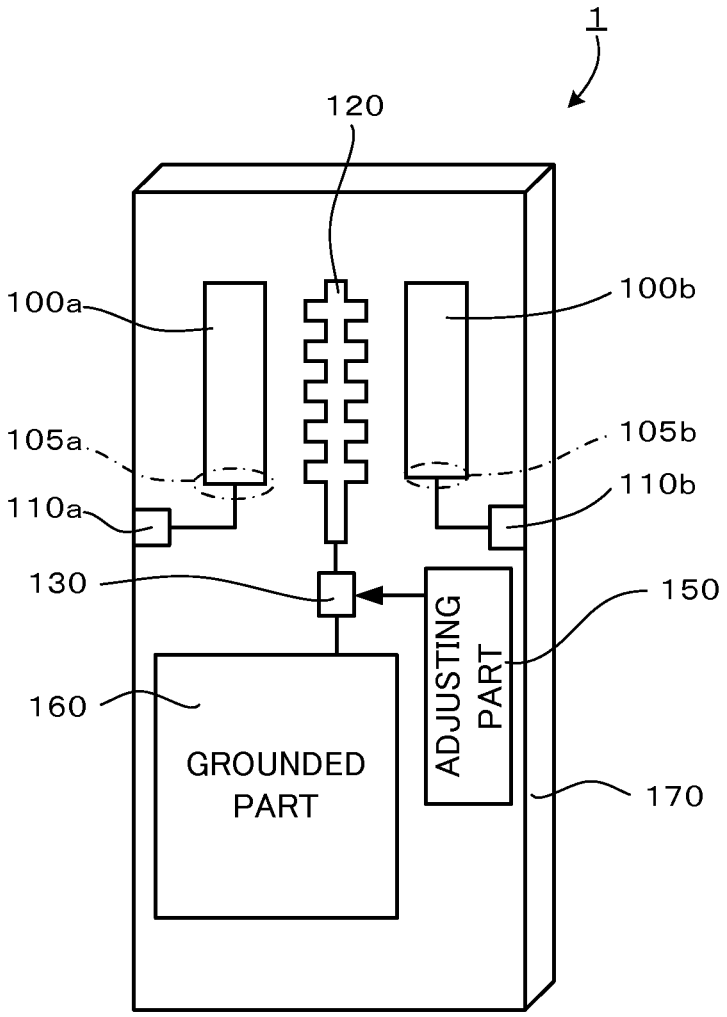
FIG. 1 is a diagram showing a configuration of a miniature variable-beam microwave antenna according to an embodiment of the present invention.

As shown in FIG. 1, the miniature variable-beam microwave antenna 1 comprises antenna conductors 100*a*, 100*b*, connection pads 110*a*, 110*b*, an EBG (EBG: Electromagnetic Band Gap) conductor 120, a variable reactance element 130, an adjusting part 150, a grounded part 160, and a substrate 170.

The antenna conductor 100*a* and the antenna conductor 100*b* are each formed of a rectangular conductor plate. The antenna conductor 100*a* and the antenna conductor 100*b* are arranged on the same plane (i.e., a main plane of the substrate 170) with respective lengthwise directions being parallel to each other.

Note that the antenna conductors 100*a*, 100*b* have a size and a shape configured so that a gain becomes a peak at, in particular, 5 GHz.

The connection pad 110*a* and the connection pad 110*b* are formed on a plane of the substrate 170 in a connectable manner to an external circuit. Respective one ends of the antenna conductors 100*a*, 100*b* operate as feeding points 105*a*, 105*b*. The feeding point 105*a* of the antenna conductor 100*a* is connected to the connection pad 110*a* through a feeder wire. Moreover, the feeding point 105*b* of the antenna 100*b* is connected to the connection pad 110*b* through a feeder wire. The antenna conductors 100*a*, 100*b* each emits a transmitting signal supplied to each feeding point 105*a*, 105*b* through each connection pad 110*a*, 110*b* and each feeder wire into a space as a radio wave, and converts a received radio wave into an electric signal and transmits such an electric signal from each feeding point 105*a*, 105*b* to each connection pad 110*a*, 110*b* through each feeder wire.

The EBG conductor 120 is arranged on a plane of the substrate 170 between the antenna conductors 100*a*, 100*b* in such a way that the axis of the EBG conductor 120 is located on the same plane as the plane where the antenna conductors 100*a*, 100*b* are located. Moreover, the respective lengthwise directions of the antenna conductors 100*a*, 100*b* and that of the EBG conductor 120 are set to be parallel to one another.

The EBG conductor 120 is a conductor plate having a thin part and a thick part being repeated periodically. The EBG conductor 120 can be expressed as an equivalent circuit having filters each including an inductance and a capacitance being connected in series. An electromagnetic wave transmitted/received by each of the antenna conductors 100*a*, 100*b* induces a current to the EBG conductor 120. As an electromagnetic wave emitted by the induced current of the EBG conductor 120 and the electromagnetic wave transmitted/received by each of the antenna conductors 100*a*, 100*b* interfere with each other and are mutually increased or weakened depending on the direction of propagation, the directivity of each of the antenna conductors 100*a*, 100*b* changes.

Note that as being arranged in a line-symmetric manner with respect to the EBG conductor 120, the directivities of the antenna conductors 100*a*, 100*b* become mirror-reversed patterns. Consequently, an interference pattern between the antenna conductor 100*a* and the EBG conductor 120 intensively emits a radio wave to an antenna-conductor-100*a* side (left side in FIG. 2) only, and an interference pattern between the antenna conductor 100*b* and the EBG conductor 120 intensively emits a radio wave to an antenna-100*b* side (right side in FIG. 2) only. Accordingly, directions in which the two antenna conductors 100*a*, 100*b* intensively emit respective radio waves are different from each other.

Moreover, with respect to the radio wave emitted by the antenna conductor 100*a*, the EBG conductor 120 suppresses any emission to the antenna-conductor-100*b* side. Accordingly, any interference with the antenna conductor 100*a* or with the antenna conductor 100*b* is restrained, so that the antenna conductors 100*a*, 100*b* can be arranged close to each other across the EBG conductor 120.

The variable reactance element 130 is an element having its own reactance changing under the control of the adjusting part 150. The variable reactance element 130 has one end connected to one end of the EBG conductor 120, and has the other end grounded to the grounded part 160. The variable reactance element 130 comprises a reactance circuit including, for example, a varactor diode and an operational amplifier circuit.

As the reactance of the variable reactance element 130 changes, the reactance of a series circuit including the EBG conductor 120 and the variable reactance element 130, i.e., the apparent reactance of the EBG conductor 120 changes.

For example, in accordance with an operation given by a user, the adjusting part 150 adjusts the reactance of the variable reactance element 130 by controlling a control voltage applied to the variable reactance element 130.

The grounded part 160 includes a conductor plate and is grounded.

The substrate 170 includes an insulating substrate including a dielectric plate.

Next, an explanation will be given of an operation of the miniature variable-beam microwave antenna 1 with the above-explained configuration.

When the miniature variable-beam microwave antenna 1 is used as an antenna for transmission, different transmission-target signals are respectively superimposed on carrier waves each having a desired frequency and supplied to the feeding points 105*a*, 105*b* of the respective antenna conductors 100*a*, 100*b* through the connection pads 110*a*, 110*b*. Accordingly, the different transmission-target signals each at a desired frequency band are emitted from both antenna conductors 100*a*, 100*b*, respectively, in directions having directivities different from each other. Each of the signals transmitted in such a way passes through a different propagation channel, so that a correlation thereof becomes small.

Conversely, when the miniature variable-beam microwave antenna 1 is used as an antenna for reception, the antenna conductor 100*a* receives a signal with two different signals being mixed and supplies such a signal to the connection pad 110*a* through the feeding point 105*a*, and the antenna conductor 100*b* receives a signal with two different signals being mixed in a differently than that received by the antenna conductor 100*a* and supplies such a signal to the connection pad 110*b* through the feeding point 105*b*. In general, difference in incident directions from each other corresponds to difference in the way of scattering in the halfway of respective propagation channels, and a radio wave with a different incident direction has a different propagation path and a different transfer coefficient. Because the two antennas have different directions in which a radio wave is received, thus different intensities, the way the two different signals are mixed may differ significantly. As the signals mixed in the different ways can be separated from each other, two different data signals may be reproduced without inference from the other signal upon separation. In this case, because it is also advantageous for the antenna conductor to select a direction in which an incident signal is intensive, in addition to the difference in the directions in which respective radio waves are received intensively, it becomes further effective for the antenna conductor if a direction can be finely adjusted to a direction in which a signal intensity is strong relative to directions of other antenna conductors.

Moreover, the variable reactance element 130 has a reactance adjusted by the adjusting part 150. At this time, respective characteristics themselves of the antenna conductors 100*a*, 100*b* do not change, but the characteristic of the miniature variable-beam microwave antenna 1, in particular, the directivity thereof has a directivity corresponding to a combined reactance of the reactance of the EBG conductor 120 and the reactance of the variable reactance element 130. When the reactance of the variable reactance element 130 is changed by the adjusting part 150, the combined reactance changes, and the directivity of the miniature variable-beam microwave antenna 1 also changes.

Next, an explanation will be given of the directivity of the miniature variable-beam microwave antenna 1 with reference to FIG. 2 to FIG. 4.

Figure 2:
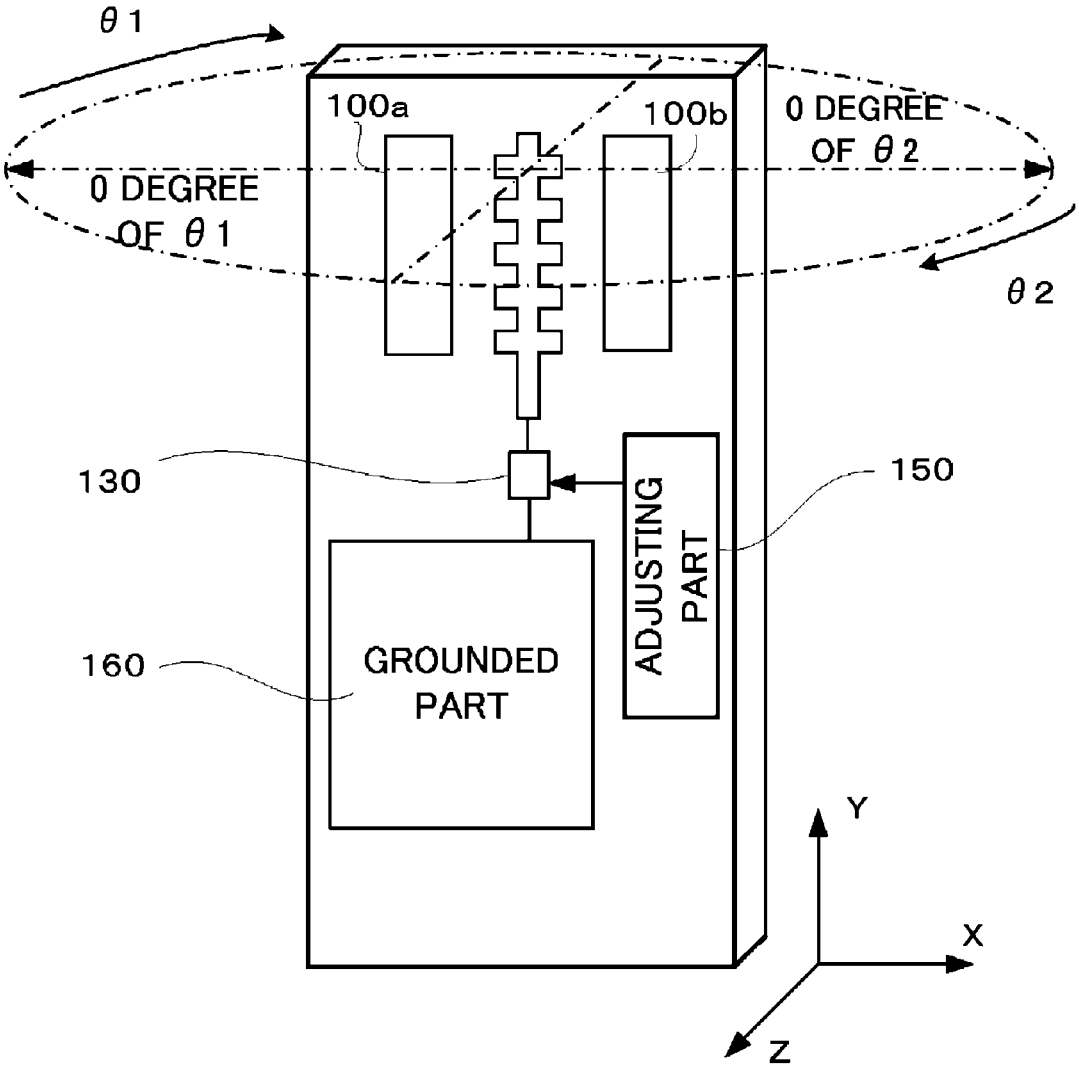
FIG. 2 is a diagram for explaining an angle of a directivity of the miniature variable-beam microwave antenna in FIG. 1.

As shown in FIG. 2, X, Y, and Z coordinates are set for the miniature variable-beam microwave antenna 1. FIG. 3 is a diagram for explaining angles θ1, θ2 on an X-Z plane as viewed from a Y direction.

Figure 4:
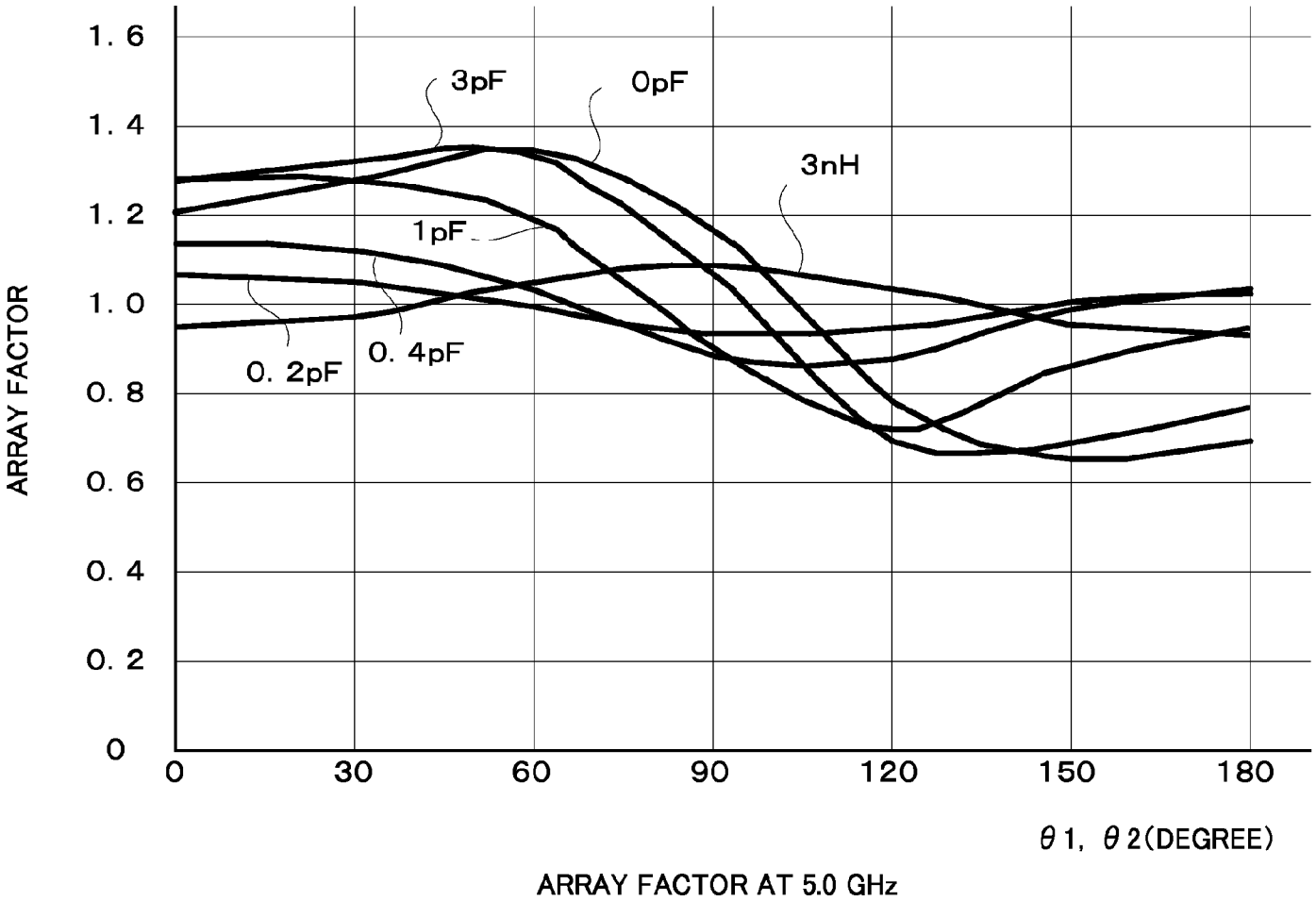
FIG. 4 is a diagram showing a directivity of a radio wave at 5.0 GHz of the miniature variable-beam microwave antenna in FIG. 1.

Moreover, an array factor of the miniature variable-beam microwave antenna 1 on the X-Z plane of the miniature variable-beam microwave antenna 1 is shown in FIG. 4.

FIG. 4 is a diagram showing an illustrative array factor of the miniature variable-beam microwave antenna 1 at 5.0 GHz. The horizontal axis represents the angles θ1, θ2 (degree), and the vertical axis represents the array factor. The figure shows cases in which the reactance of the variable reactance element 130 is 3 nH, 0 pF, 0.2 pF, 0.4 pF, 1 pF, and 3 pF, respectively.

Figure 3:
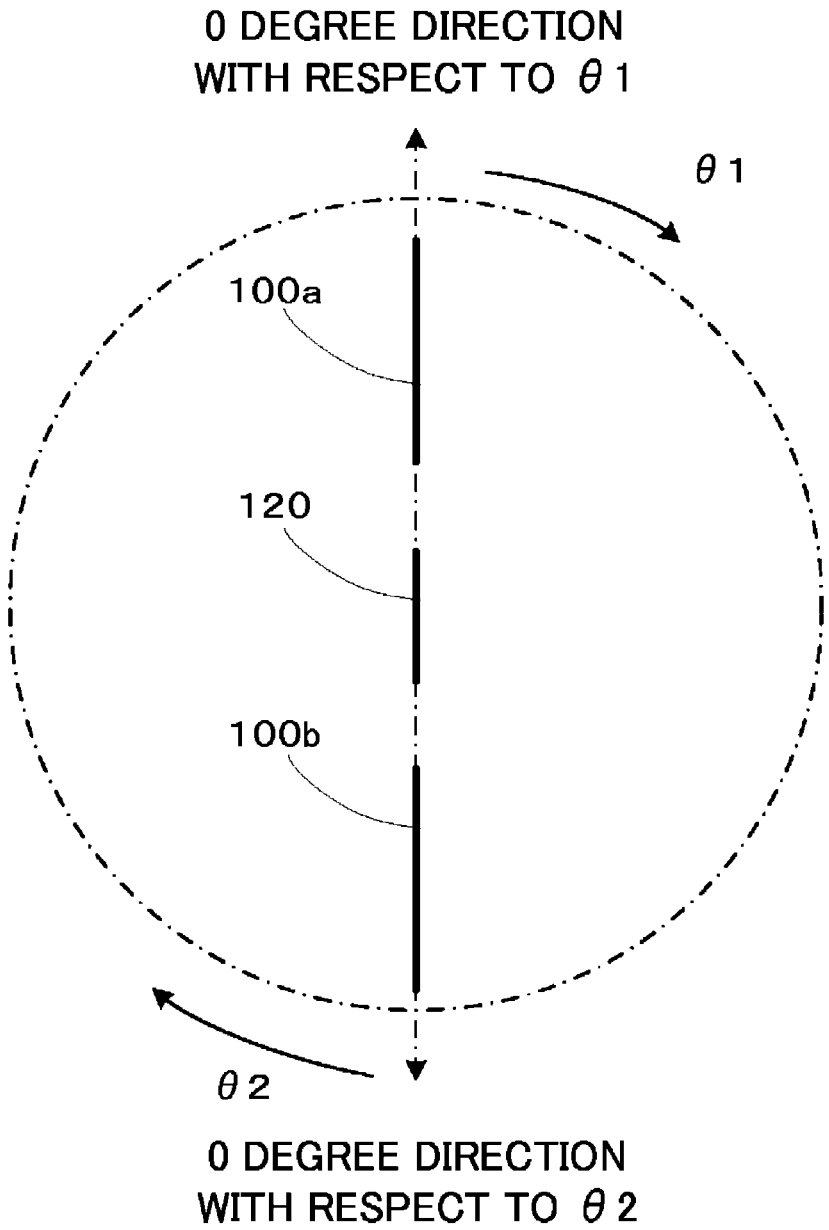
FIG. 3 is a diagram for explaining the angle of the directivity of the miniature variable-beam microwave antenna in FIG. 1.

Note that as shown in FIG. 2 and FIG. 3, with a direction from the EBG conductor 120 toward the antenna conductor 100*a* being as a 0 o'clock direction, the angle θ1 is an angle in a clockwise direction from the 0 o'clock direction around the EBG conductor 120. Moreover, as shown in FIG. 2 and FIG. 3, with a direction from the EBG conductor 120 toward the antenna conductor 100*b* being as a 0 o'clock direction, the angle θ2 is an angle in a clockwise direction from the 0 o'clock direction around the EBG conductor 120.

As is clear from FIG. 4, together with the change of the reactance of the variable reactance element 130, the angles θ1, θ2 each having a peak indicated by the array factor change. That is, the directivity changes. In this fashion, the miniature variable-beam microwave antenna 1 can control the directivity thereof, and the adjusting part 150 sets the reactance of the variable reactance element 130 so as to acquire the directivity in a desired direction.

Second Embodiment

The miniature variable-beam microwave antenna 1 with the above-explained configuration can be mounted and packaged together with, for example, a semiconductor chip.

An explanation will be given of a packaged miniature variable-beam microwave antenna according to the second embodiment.

Figure 5:
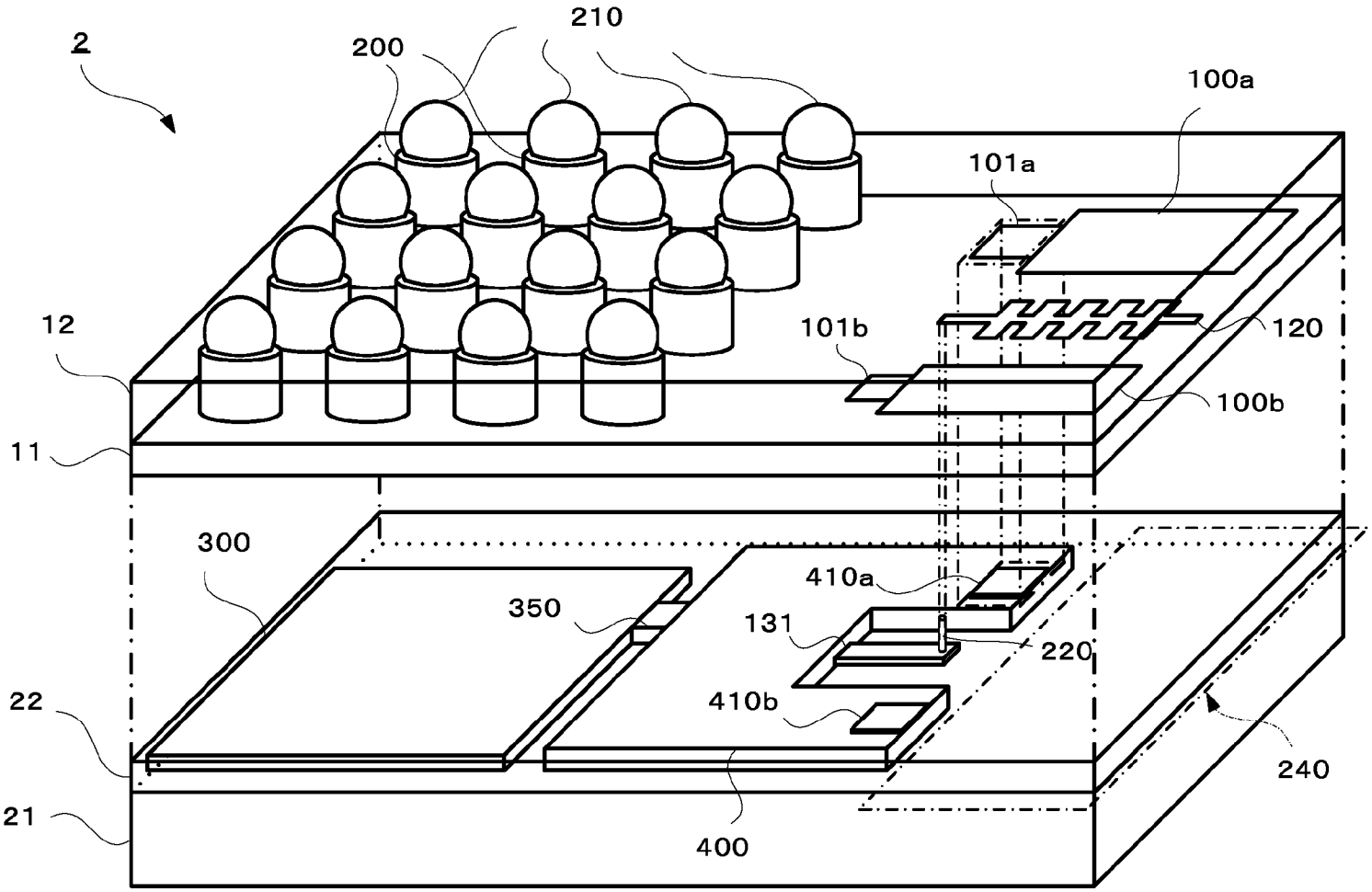
FIG. 5 is a diagram showing an example case how the miniature variable-beam microwave antenna in FIG. 1 is mounted.

As shown in FIG. 5, a miniature variable-beam microwave antenna 2 of the second embodiment comprises a first protective layer 11, an encapsulation resin layer 12, a substrate 21, a second protective layer 22, antenna conductors 100*a*, 100*b*, an EBG conductor 120, a via 220, a varactor diode 131, an antenna area 240, posts 200, BGAs 210 (BGA: Ball Grid Array), a digital circuit 300, a connection part 350, and a high-frequency circuit 400.

The first protective layer 11 comprises an insulating film like polyimide, has the antenna conductors 100*a*, 100*b*, the EGB conductor 120, and the post 200 arranged on the first protective layer 11, and is covered by the encapsulation resin layer 12. Note that the antenna conductors 100*a*, 100*b* have a size so adjusted that a gain is acquired at 5 GHz.

The first protective layer 11 electrically disconnects individual elements on the substrate 21 from the exterior, and the encapsulation resin layer 12 protects the elements by covering such elements.

The substrate 21 comprises a semiconductor substrate, has the digital circuit 300, the high-frequency circuit 400, and the varactor diode 131 that functions as a variable reactance element arranged on the substrate 21, and is protected by the second protective layer 22.

The second protective layer 22 comprises an insulating film like silicon nitride, electrically disconnects the elements from the exterior, and protects the elements from mechanical stress and entering of impure substances.

A part of the substrate 21 facing the antenna conductors 100*a*, 100*b* configures the antenna area 240. No element, no circuit, no wiring, etc., is arranged in the antenna area 240. As no element, no circuit, no wiring, etc., is arranged, it is possible to prevent radio waves transmitted/received by the antenna conductors 100*a*, 100*b* from being absorbed and being reflected by conductive materials configuring a circuit and a wiring.

The via 220 is formed so as to pass all the way through the first protective layer 11 and through the second protective layer 22, and a conductor having one end connected to the EBG conductor 120 and the other end connected to the varactor diode 131 is filled in the via 220.

The varactor diode 131 has one end connected to the via 220, and is electrically connected to the EBG conductor 120 through the via 220.

The posts 200 are arranged on the first protective layer 11, and are formed so as to pass all the way through the encapsulation resin layer 12. Each post 200 has one end connected to the BGA 210, and is connected to the digital circuit 300 through a non-illustrated drawing wiring connected to the other end of the post.

The post 200 supplies a signal input through the BGA 210 to the digital circuit 300 through the drawing wiring, and outputs a signal output by the digital circuit 300 to the exterior through the BGA 210.

The BGA 210 comprises a spherical solder ball or the like, and is connected to the post 200. The BGA 210 functions not only as a fixing member which fixes the modularized miniature variable-beam microwave antenna 2 to a circuit substrate, but also as a terminal of the miniature variable-beam microwave antenna 2, and a signal input/output to the miniature variable-beam microwave antenna 2 is input/output through the BGA 210.

The digital circuit 300 is arranged on the substrate 21, and is connected to the high-frequency circuit 400 through the connection part 350. The digital circuit 300 inputs/outputs signals via the posts 200 and the connection part 350. When receiving digital information though the posts 200, the digital circuit 300 executes a radio-wave transmission process to be discussed later. Moreover, when receiving analog information through the connection part 350, the digital circuit 300 executes a radio-wave reception process to be discussed later.

The miniature variable-beam microwave antenna 2 transmits/receives information signals through the radio-wave transmission process and radio-wave reception process both of which are processed by the digital circuit 300.

The connection part 350 is a connector arranged on the substrate 21, and connects the digital circuit 300 and the high-frequency circuit 400 together.

The high-frequency circuit 400 is connected to the digital circuit 300 through the connection part 350, and is connected to respective connection conductors 101*a*, 101*b* of the antenna conductors 100*a*, 100*b* through respective connection conductors 410*a*, 410*b*. Moreover, the high-frequency circuit 400 is connected to the varactor diode 131. When a transmitting signal and specifying information on a radio wave that convey the transmitting signal are input from the digital circuit 300, the high-frequency circuit 400 applies a high-frequency voltage having the input transmitting signal and a carrier wave superimposed with each other for each of the antenna conductors 100*a*, 100*b* through each connection conductor 410*a*, 410*b*, respectively.

Furthermore, when the antenna conductors 100*a*, 100*b* receive a radio wave, and by means of the received radio wave a high-frequency voltage is input into the high-frequency circuit 400, the high-frequency circuit 400 detects a received signal and outputs the detected signal to the digital circuit 300.

The antenna conductors 100*a*, 100*b* and the high-frequency circuit 400 are electrically connected together by inductive coupling by the connection conductors 101*a*, 101*b* and by the connection conductors 410*a*, 410*b*. The connection conductors 101*a*, 101*b* are arranged on the first protective layer 11, and are connected to the antenna conductors 100*a*, 100*b*, respectively. The connection conductors 410*a*, 410*b* are arranged on the substrate 21, and are connected to respective input/output terminals of the high-frequency circuit 400. The connection conductor 101*a* and the connection conductor 410*a* are electrically connected by inductive coupling, and the connection conductor 101*b* and the connection conductor 410*b* are electrically connected by inductive coupling.

The transmission operation of the miniature variable-beam microwave antenna 2 with the above-explained configuration and the reception operation thereof are basically the same as those of the miniature variable-beam microwave antenna 1 in the first embodiment.

Figure 6:
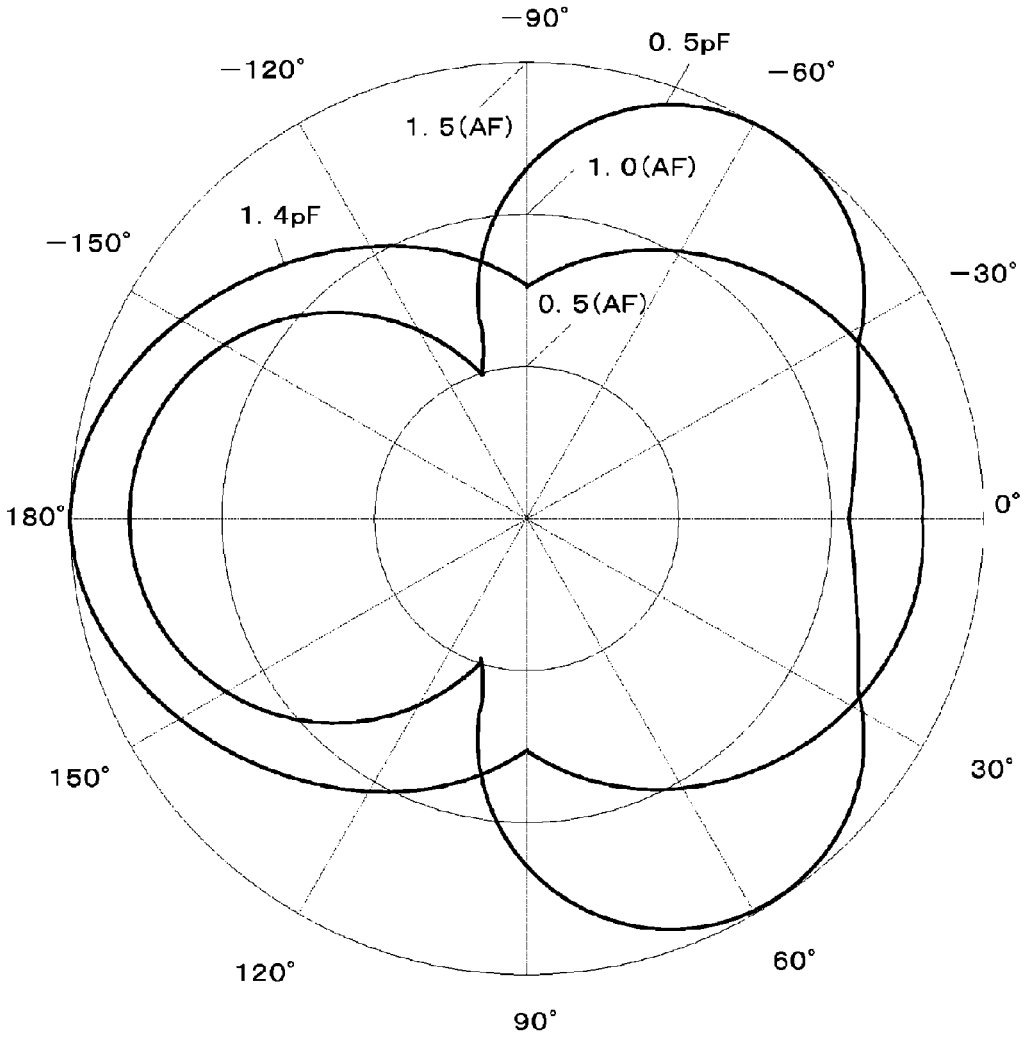
FIG. 6 is a diagram showing a directivity of a radio wave at 5.0 GHz of a miniature variable-beam microwave antenna in FIG. 5.

FIG. 6 shows an illustrative directivity of the miniature variable-beam microwave antenna 2.

FIG. 6 is a diagram showing an array factor at 5 GHz relative to the angles θ1, θ2 in FIG. 2 and FIG. 3 when the reactance of the varactor diode 131 is adjusted to 1.4 pF, 0.5 pF respectively.

As is clear from FIG. 6, the directivity of the miniature variable-beam microwave antenna 2 can be adjusted by adjusting a variable reactance connected to the EBG conductor 120.

Next, an explanation will be given of the radio-wave transmission process and the radio-wave reception process both executed by the digital circuit 300.

Figure 7:
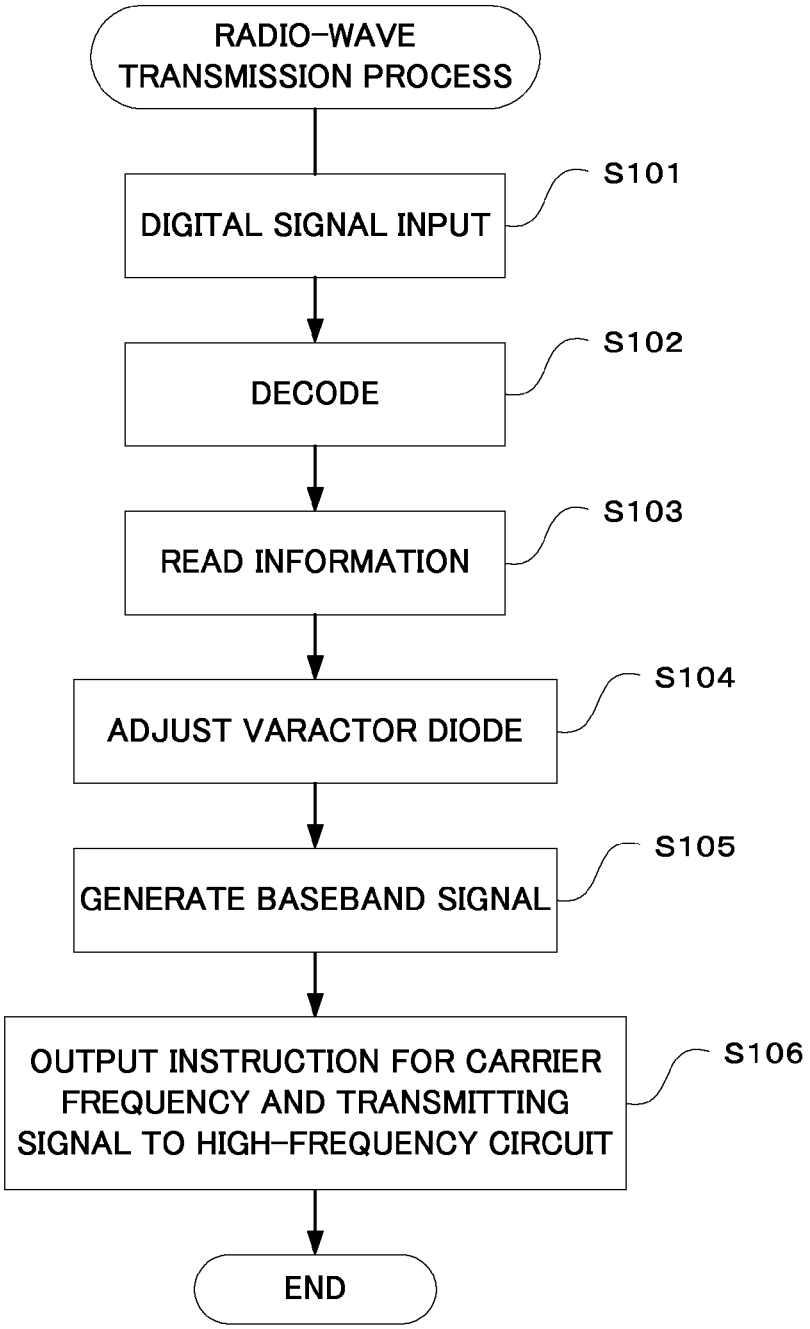
FIG. 7 is a flowchart showing a radio-wave transmission process by the miniature variable-beam microwave antenna in FIG. 5.

First, an explanation will be given of the radio-wave transmission process with reference to a flowchart of FIG. 7.

As a digital signal is input from a transmitting device through the BGA 210 and the post 200 (step S101), the digital circuit 300 decodes the input signal (step S102).

The digital circuit 300 reads information on a transmission target, a carrier frequency, and an angle (a direction) in which a radio wave is transmitted from the decoded signal (step S103).

Figure 8:
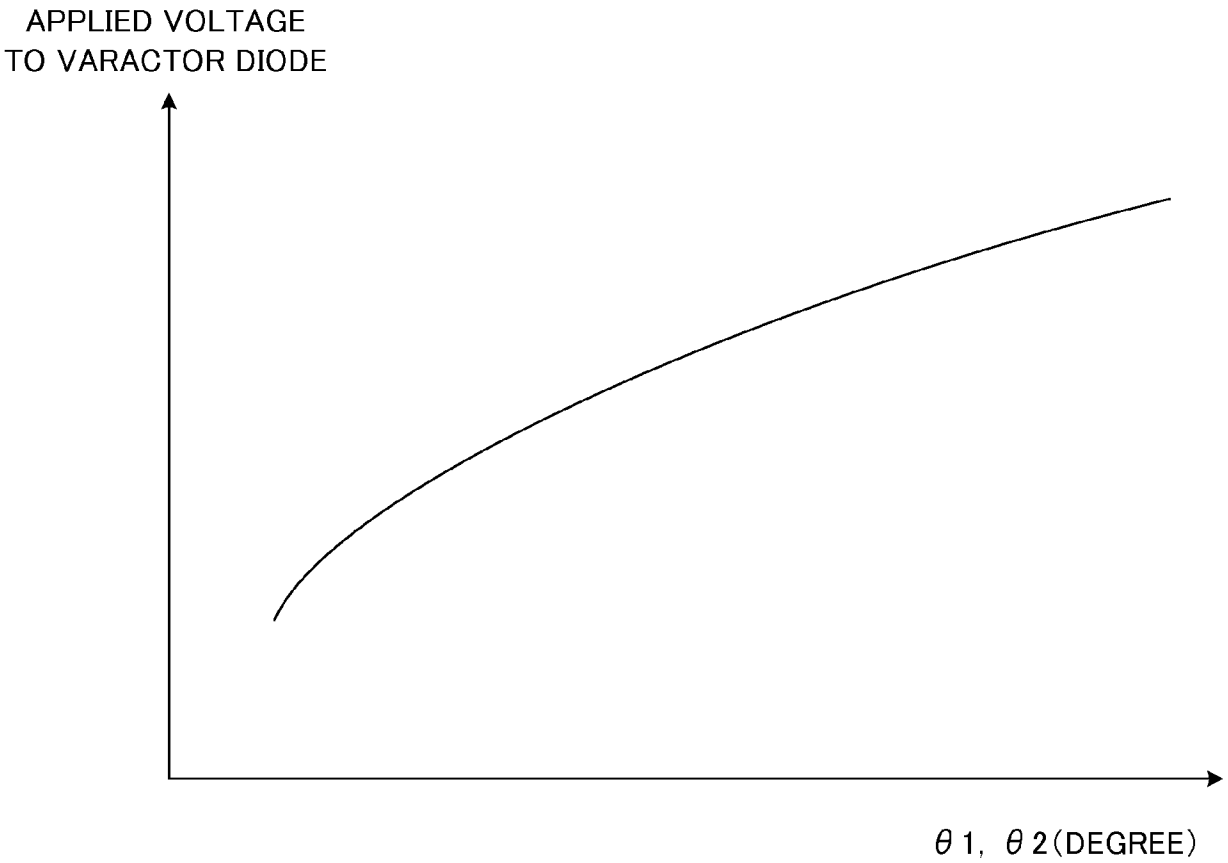
FIG. 8 is a diagram showing an illustrative relationship between an applied voltage to a varactor diode of the miniature variable-beam microwave antenna in FIG. 5 and a directivity thereof.

As shown in FIG. 8, with respect to the antenna conductors 100*a*, 100*b*, a relationship between main transmission directions (directivities) θ1, θ2 of radio waves and an applied voltage to the varactor diode is stored in an internal memory of the digital circuit 300 beforehand.

When reading the carrier frequency and the transmission angle (direction), the digital circuit 300 refers to the internal memory and applies a voltage to the varactor diode 131 to adjust the directivity of a transmitting radio wave to an appropriate condition so as to have the directivity in an instructed main transmission direction by using the antenna conductors 100*a*, 100*b* (step S104).

Moreover, the digital circuit generates a baseband signal from the read transmission information (step S105), and transmits the generated baseband signal together with a command instructing the carrier frequency to the high-frequency circuit 400 (step S106).

The high-frequency circuit 400 modulates a carrier wave at the instructed frequency with the baseband signal, and supplies the modulated signal to the antenna conductor 100*a* or 100*b* to be used to emit the modulated signal.

In this fashion, the miniature variable-beam microwave antenna 2 can emit a desired transmission-target signal at a desired carrier frequency with a directivity in a desired direction.

Figure 9:
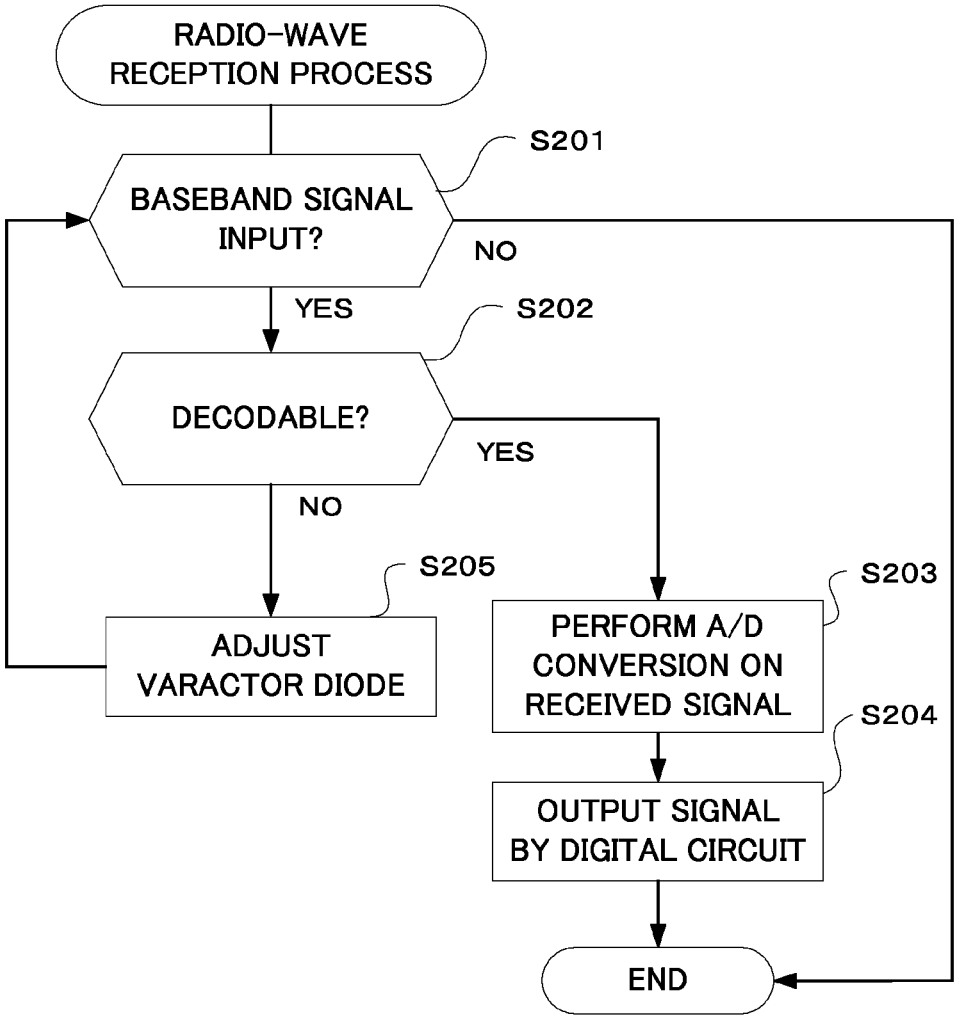
FIG. 9 is a flowchart showing a radio-wave reception process by the miniature variable-beam microwave antenna in FIG. 5.

Next, an explanation will be given of the radio-wave reception process with reference to a flowchart in FIG. 9.

The antenna conductors 100*a*, 100*b* each has a directivity corresponding to a voltage applied to the varactor diode 131, and receives a radio wave at a desired frequency band. The antenna conductors 100*a*, 100*b* each supplies a received signal to the high-frequency circuit 400.

The high-frequency circuit 400 demodulates the signal received by each of the antenna conductors 100*a*, 100*b*, reproduces a baseband signal and inputs the reproduced baseband signal in the digital circuit 300.

When the baseband signal is input from the high-frequency circuit 400 (step S201: "YES"), the digital circuit 300 determines whether or not the input baseband signal is decodable (step S202).

When the input baseband signal is decodable (step S202 "YES"), the digital circuit 300 performs A/D conversion on the received signal (step S203), processes the converted signal as needed, and outputs the processed digital signal to the exterior through the posts 200 (step S204).

Conversely, when the input baseband signal is not decodable (step S202: "NO"), the digital circuit 300 changes a voltage to be applied to the varactor diode 131 by what corresponds to, for example, ΔV to adjust the directivity of the antenna (step S205), and when a baseband signal is input (step S201: "YES"), the digital circuit determines again whether or not the input baseband signal is decodable (step S202). Thereafter, until no radio wave is received, and thus no baseband signal is input (step S201: "NO") or until an input baseband signal becomes decodable (step S202: "YES"), a sequence of the operations is continued.

In this fashion, it becomes possible for the miniature variable-beam microwave antenna to appropriately receive a weak radio wave from an arbitrary direction and to reproduce an original signal by automatically adjusting the directivity of the antenna.

As explained above, the miniature variable-beam microwave antenna 2 of the second embodiment can automatically maintain an optimum directivity for transmission/reception of a radio wave.

Figure 10:
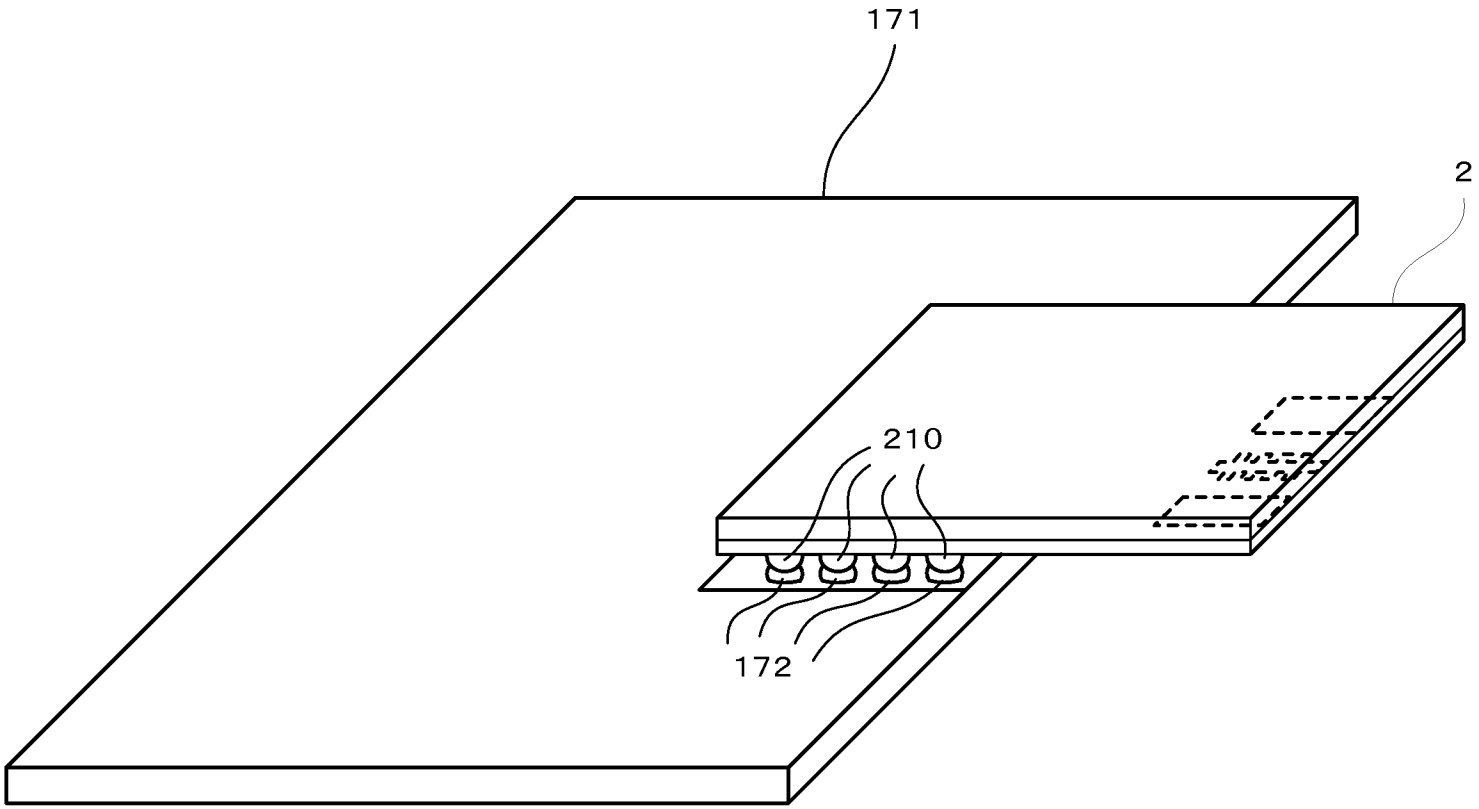
FIG. 10 is a diagram showing an example case how the miniature variable-beam microwave antenna in FIG. 5 is mounted.

For example, as shown in FIG. 10, as the BGAs 210 are soldered onto plural connection pads 172 arranged at a side of a circuit substrate 171, the miniature variable-beam microwave antenna 2 employing the above-explained configuration is fixed and electrically connected, and is used. At this time, in order to suppress any cutoff of a radio wave and any reflection thereof, it is desirable that an antenna part should be connected protrudingly toward the exterior of the circuit substrate 171. Alternatively, it is desirable to devise a circuit arrangement so that no conductor overlaps the antenna area 240.

The present invention is not limited to the foregoing embodiments, and various changes and applications can be made.

For example, in the above-explained illustrative configurations, the explanation was given of a case in which the antenna conductors 100*a*, 100*b* each has the size and the shape enabling acquisition of a large gain at a frequency band of 5 GHz. The present invention is not limited to this configuration.

It is possible to adjust a gain at an arbitrary frequency band by setting each of the antenna conductors 100*a*, 100*b* to have a size and a shape appropriate for a target frequency.

Figure 11:
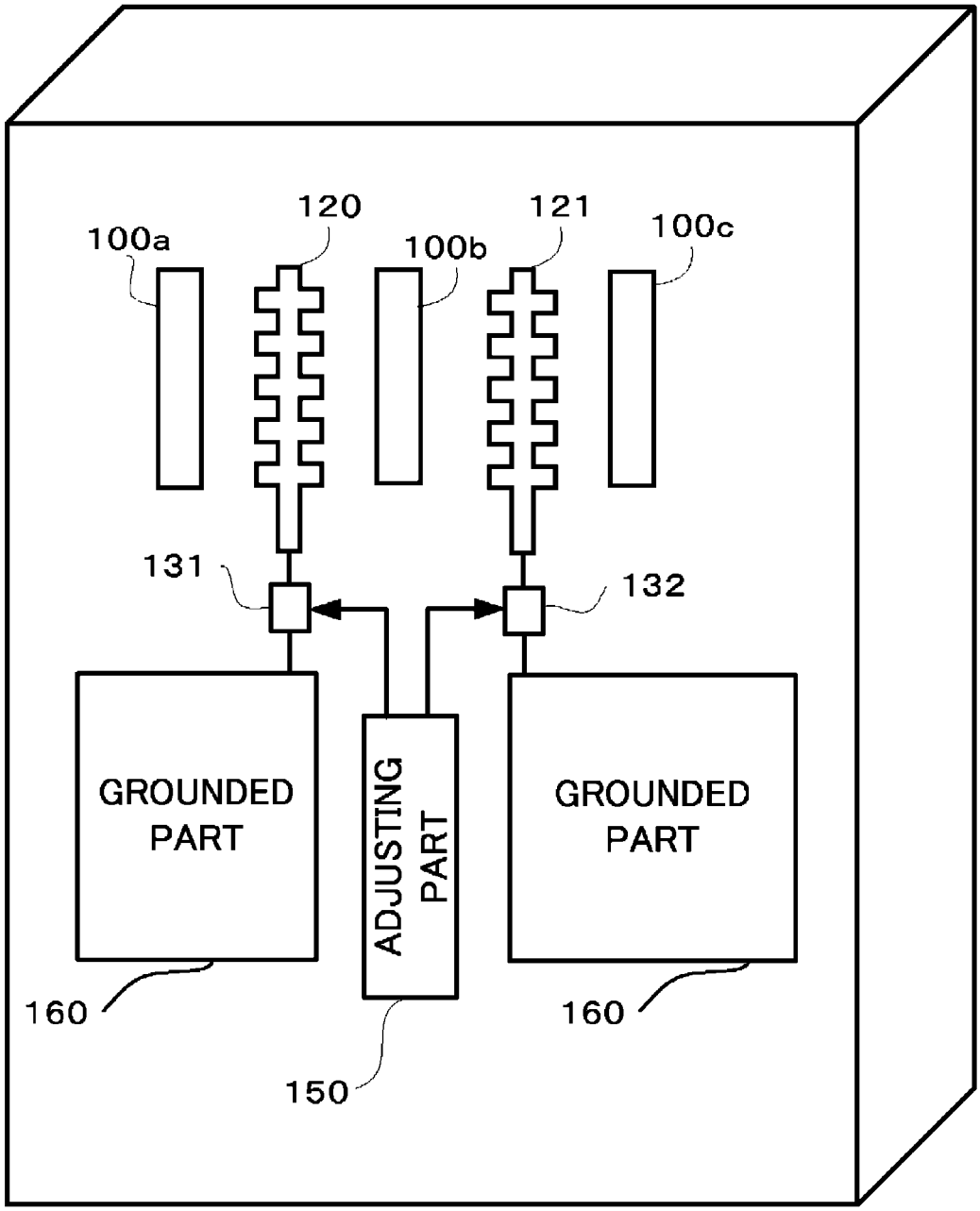
FIG. 11 is a diagram showing an illustrative application of the miniature variable-beam microwave antenna in FIG. 2.

Moreover, for example, in the foregoing embodiments, although the two antenna conductors are arranged and the EBG is arranged therebetween, the number of the antenna conductors and the number of the EBG are not limited to those numbers. For example, as exemplified in FIG. 11, three antenna conductors 100*a*, 100*b*, 100*c* may be arranged and each of EBG conductors 120, 121 may be arranged between adjoining two antenna conductors.

In this case, it is appropriate if respective capacitances of varactor diodes 131, 132 are so adjusted as to cause the directivity of the antenna conductor corresponding to a target frequency to be a target characteristic.

According to this configuration, the directivity can be more finely adjusted to carry out a communication.

Furthermore, for example, in the configuration of the miniature variable-beam microwave antenna 2, although the BGA 210 is used for a connection with the exterior, it is not necessary that connection means is the BGA as long as information can be electrically exchanged with the exterior, and the configuration using an LGA (Land Grid Array) or the like may be employed.

Moreover, for example, in the configuration of the miniature variable-beam microwave antenna 2, although a single substrate is used, the number of substrates is not limited to one as long as the antenna conductors 100*a*, 100*b* and the EBG conductor 120 are on the same plane.

For example, the elements may be arranged on respective substrates different from each other.

Moreover, although the explanation was given of a case in which the connection conductors 101*a*, 101*b* and the connection conductors 410*a*, 410*b* are electrically connected together by inductive coupling, it is not necessary that those conductors are connected together by inductive coupling as long as a signal can be electrically transmitted/received therethrough.

For example, those conductors may be connected together through a via filled with a conductive material, or may be connected together by slot coupling.

However, the employment of a technique of electrically connecting those conductors by using magnetism, e.g., the slot coupling or the inductive coupling, enables reduction in production and material costs.

Moreover, the shape of the antenna conductor is not limited to any particular one, and a positional relationship between the antenna conductor and the EBG conductor is not limited to any particular one as long as the radio wave of the antenna conductor can be blocked off and reflected. For example, a plurality of rhomboid, triangular, or sector antenna conductors may be arranged around the EBG conductor so as to surround it.

However, like the foregoing embodiments, controllability of a directivity becomes better by employing a configuration with an antenna conductor having a rectangular tabular shape and with an EBG conductor being arranged between two antenna conductors arranged parallel to each other side by side.

This application is based on Japanese Patent Application No. 2009-203147 filed on Sep. 2, 2009. The specification, claims, and drawings of this Japanese Patent Application No. 2009-203147 are entirely incorporated herein by reference in this specification.

INDUSTRIAL APPLICABILITY

An antenna of the present invention can be utilized in the field of industrial technologies of wireless communication.

DESCRIPTION OF REFERENCE NUMERALS

1, 2 Miniature variable-beam microwave antenna
11 First protective layer
12 Encapsulation resin layer
21 Substrate
22 Second protective layer
100*a*, 100*b*, 100*c* Antenna conductor (antenna element)
101*a*, 101*b*, 410*a*, 410*b* Connection conductor
105*a*, 105*b* Feeding point
110*a*, 110*b*, 172 Connection pad
120, 121 EBG conductor
130 Variable reactance element
131,132 Varactor diode
150 Adjusting part
160 Grounded part
170 Substrate
171 Circuit substrate
200 Post
210 BGA
220 Via

240 Antenna area
300 Digital circuit
350 Connection part
400 High-frequency circuit

The invention claimed is:

1. An antenna comprising:

an antenna conductor;

an electromagnetic-band-gap conductor which blocks off and reflects a radio wave emitted by the antenna conductor;

a variable reactance element which connects the electromagnetic-band-gap conductor and a reference potential part together;

an adjusting circuit which adjusts a reactance of the variable reactance element; and a first dielectric plate, wherein the antenna conductor and the electromagnetic-band-gap conductor are formed on the first dielectric plate.

2. The antenna according to claim 1, wherein the electromagnetic-band-gap conductor is arranged in a main propagation direction of a radio wave of the antenna conductor.

3. The antenna according to claim 1, wherein the antenna conductor has a rectangular tabular shape.

4. The antenna according to claim 1, wherein a plurality of the antenna conductors are provided, and the electromagnetic-band-gap conductor is arranged between two adjoining antenna conductors.

5. The antenna according to claim 1, further comprising a second dielectric plate, wherein the adjusting circuit is formed on one-side plane of the second dielectric plate.

6. The antenna according to claim 5, further comprising a high-frequency circuit which superimposes an input analog signal on a high-frequency voltage, applies the high-frequency voltage to the antenna conductor and detects an analog signal from a radio wave received by the antenna conductor, the high-frequency circuit being formed on the one-side plane of the second dielectric plate.

7. The antenna according to claim 6, wherein the high-frequency circuit is connected to the antenna conductor by slot coupling or by inductive coupling.

8. The antenna according to claim 6, further comprising a conversion circuit which converts an analog signal input from the high-frequency circuit into a digital signal, outputs the converted digital signal and converts an input digital signal into an analog signal, the conversion circuit being formed on the one-side plane of the second dielectric plate.

9. The antenna according to claim 8, wherein another-side plane of the first dielectric plate and the one-side plane of the second dielectric plate are connected together through an insulating layer comprising an insulator, and the antenna further comprises an external terminal which is connected to the conversion circuit by a wiring conductor passing all the way through the insulating layer and which is arranged on one-side plane of the first dielectric plate.

10. The antenna according to claim 9, wherein the first dielectric plate has a protective layer comprising an insulator arranged on the one-side plane of the first dielectric plate, and the external terminal passes all the way through the protective layer, has one end connected to the conversion circuit, and has another end connected to a terminal for surface mounting.

11. The antenna according to claim 1, wherein no conductive material is arranged in a planar direction of the antenna conductor.

* * * * *